US006210216B1

(12) United States Patent
Tso-Chin et al.

(10) Patent No.: US 6,210,216 B1
(45) Date of Patent: Apr. 3, 2001

(54) TWO PORT USB CABLE ASSEMBLY

(75) Inventors: David Tso-Chin, Thousand Oaks; Jeng-Yih Hwang, Irvine, both of CA (US)

(73) Assignee: Hon Hai Precision Ind. Co., Ltd., Taipei (TW)

( * ) Notice: Subject to any disclaimer, the term of this patent is extended or adjusted under 35 U.S.C. 154(b) by 0 days.

(21) Appl. No.: 09/450,480

(22) Filed: Nov. 29, 1999

(51) Int. Cl.[7] ..... H01R 13/74

(52) U.S. Cl. ..... 439/545; 439/564; 439/939; 439/701

(58) Field of Search ..... 439/545, 564, 439/939, 607, 609, 610, 701

(56) References Cited

U.S. PATENT DOCUMENTS 4,906,201 * 3/1990 Young et al. ..... 439/939
5,266,053 * 11/1993 Jamet et al. ..... 439/939
5,306,175 * 4/1994 Swanstrom ..... 439/564
5,320,554 * 6/1994 Freer et al. ..... 439/545
5,709,569 * 1/1998 Buck et al. ..... 439/939
5,772,471 * 6/1998 Buck ..... 439/939

* cited by examiner

*Primary Examiner*—Gary F. Paumen
(74) *Attorney, Agent, or Firm*—Wei Te Chung

(57) ABSTRACT

A USB (Universal Serial Bus) cable includes a cable having an end to which a connection device is attached. The connection device includes an insulative casing in which two USB connectors are fixed and electrically connected to the cable. Two bores are defined in a front wall of the casing for rotatably retaining two bolts. A conductive plate associated with each bolt is fixed in the casing having a first section defining a hole through which the bolt extends and a second section resiliently engaging with a conductive shield of the corresponding USB connector. The first section has step-like edges fixedly received in L-shaped slits defined in the front wall with the first section overlapping an outside surface of the front wall whereby when the connection device is secured to an external grounding panel by the bolts, the conductive plate engages with the grounding panel forming an electrical connection between the shield of the corresponding USB connector and the grounding panel.

2 Claims, 6 Drawing Sheets

TWO PORT USB CABLE ASSEMBLY

BACKGROUND OF THE INVENTION

1. Field of the Invention

The present invention generally relates to a USB (Universal Serial Bus) cable assembly, and in particular to a two port USB cable assembly having a grounding device for facilitating ESD (Electro-Static Discharge) and EMI protection of the USB ports.

2. The Prior Art

A USB cable comprises a cable with a USB connector mounted to an end thereof. For a USB cable mounted to a panel of a computer enclosure, an electrical engagement between a shielding shell of the USB connector of the cable and the panel is required to provide ESD and EMI protection. A variety of grounding devices is implemented in USB cables available in the market. The conventional grounding devices of USB cables either are complicated in structure or require a laborious assembly process.

On the other hand, a two port USB cable having a cable end connection device comprising two USB connectors is not common in the market. Such a two port USB cable requires a grounding device having a simple structure and being easy to assembly for facilitating the manufacture thereof and reducing costs.

It is thus desired to provide a two port USB cable having a grounding device having a simple structure and easy to assemble.

SUMMARY OF THE INVENTION

Accordingly, an object of the present invention is to provide a USB cable comprising a grounding device having a simple structure for being easy to manufacture and assembly and reducing costs.

Another object of the present invention is to provide a USB cable comprising a cable end connection device comprising two USB connectors.

A further object of the present invention is to provide an electrical connector having a grounding device having a simple structure for being easy to manufacture and assembly and reducing costs.

To achieve the above objects, a USB cable assembly in accordance with the present invention comprises a cable having an end to which a connection device is attached. The connection device comprises an insulative casing in which two USB connectors are fixed and electrically connected to the cable. Two bores are defined in a front wall of the casing for rotatably retaining two bolts. A conductive plate associated with each bolt is fixed in the casing having a first section defining a hole through which the bolt extends and a second section resiliently engaging with a conductive shield of the corresponding USB connector. The first section has step-like edges fixedly received in L-shaped slits defined in the front wall with the first section overlapping an outside surface of the front wall whereby when the connection device is secured to an external grounding panel by the bolts, the conductive plate engages with the grounding panel forming an electrical connection between the shield of the corresponding USB connector and the grounding panel.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
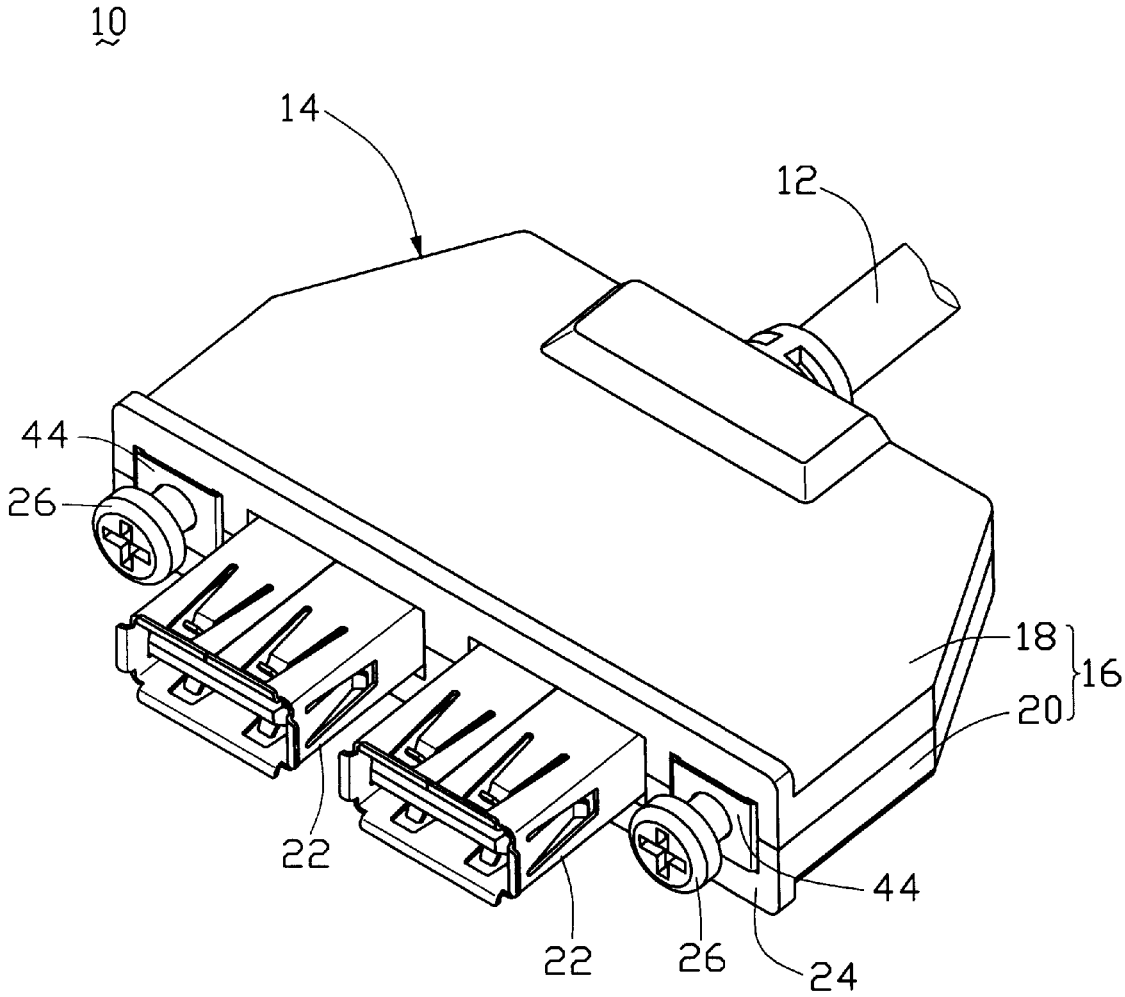
FIG. 1 is a perspective view of a USB cable assembly constructed in accordance with the present invention.
Figure 2:
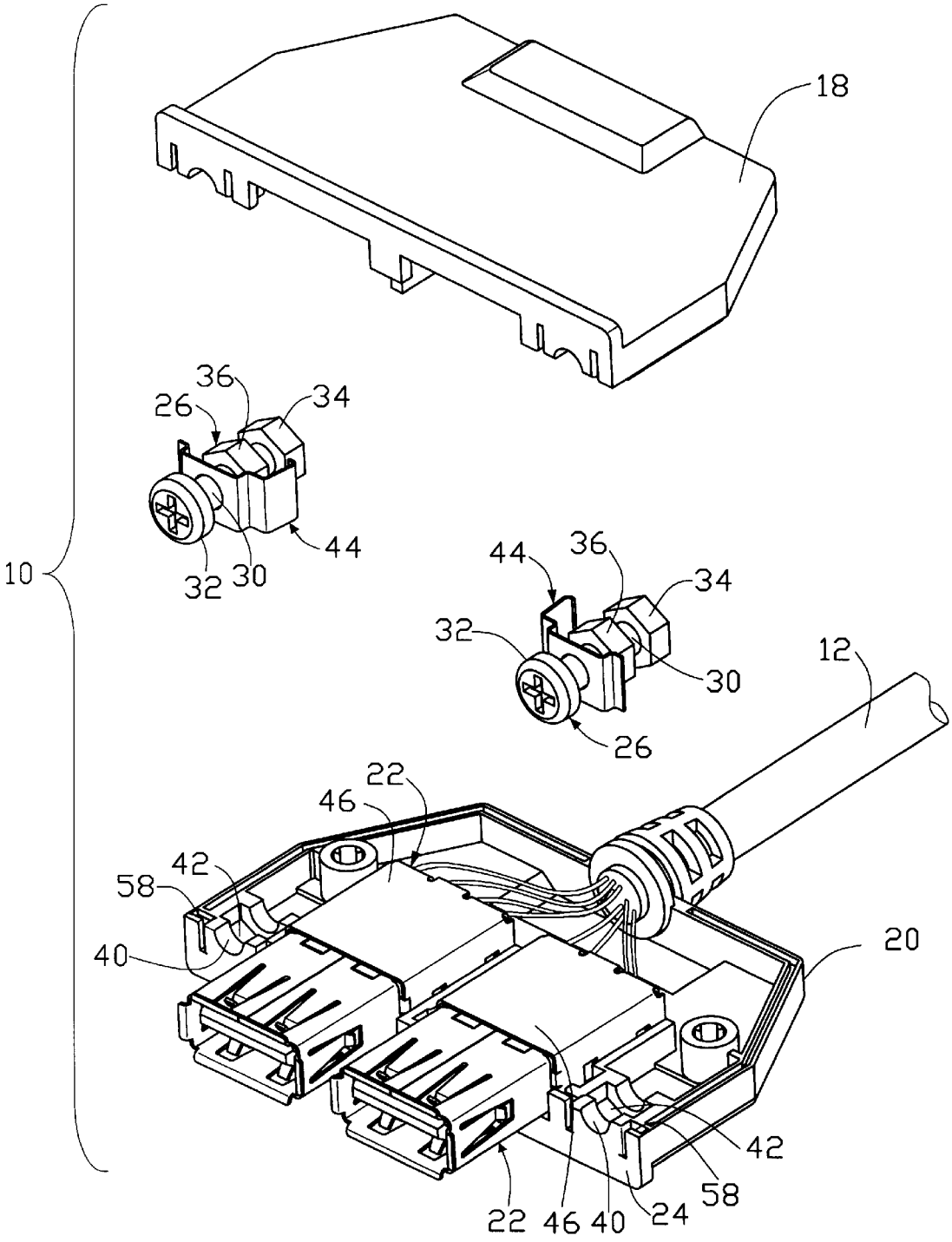
FIG. 2 is an exploded view of the USB cable assembly.
Figure 3:
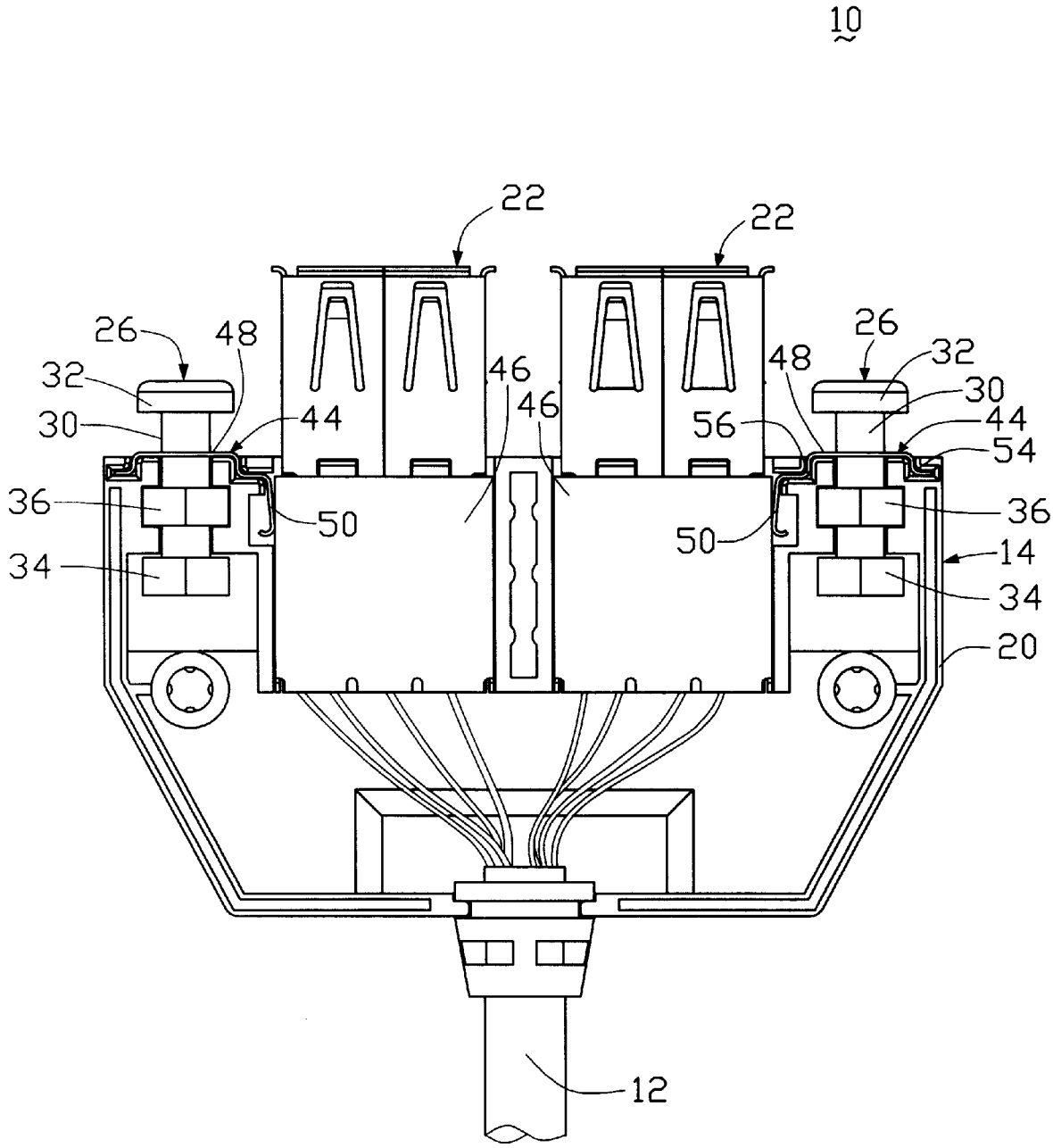
FIG. 3 is a plan view of the USB cable assembly with an upper cover member of a cable end connection device thereof removed to show inside details.

Referring to the drawings and in particular to FIGS. 1–3, a cable assembly constructed in accordance with the present invention, generally designated by reference numeral 10, comprises an elongate cable 12 and at least one cable end connection assembly 14 mounted to and electrically connected to an end of the cable 12.

The cable end connection device 14, which will be referred to as connection device hereinafter for simplicity, comprises a casing 16 made of insulative material comprising an upper casing member 18 and a lower casing member 20 fixed to each other for defining an interior space therebetween to accommodate two USB connectors 22. The USB connectors 22 are electrically connected to the cable 12 and partially protrude beyond a front wall 24 of the casing 16. The upper and lower casing members 18, 20 are fixed to each other by any known means, such as interferential fitting.

Figure 4:
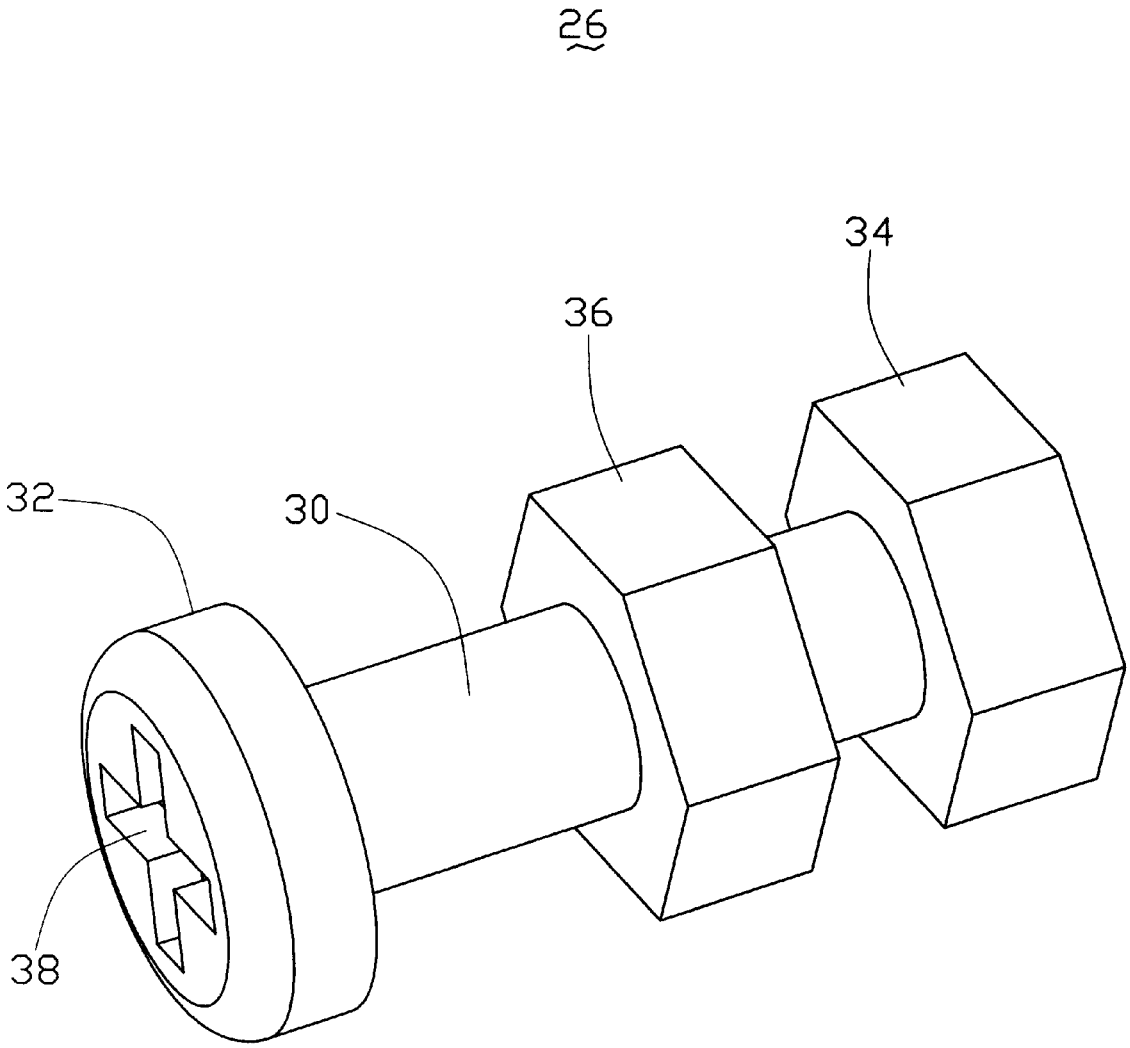
FIG. 4 is a perspective view of a fastener incorporated in the cable end connection device of the present invention for securing the cable end connection device to a panel.
Figure 6:
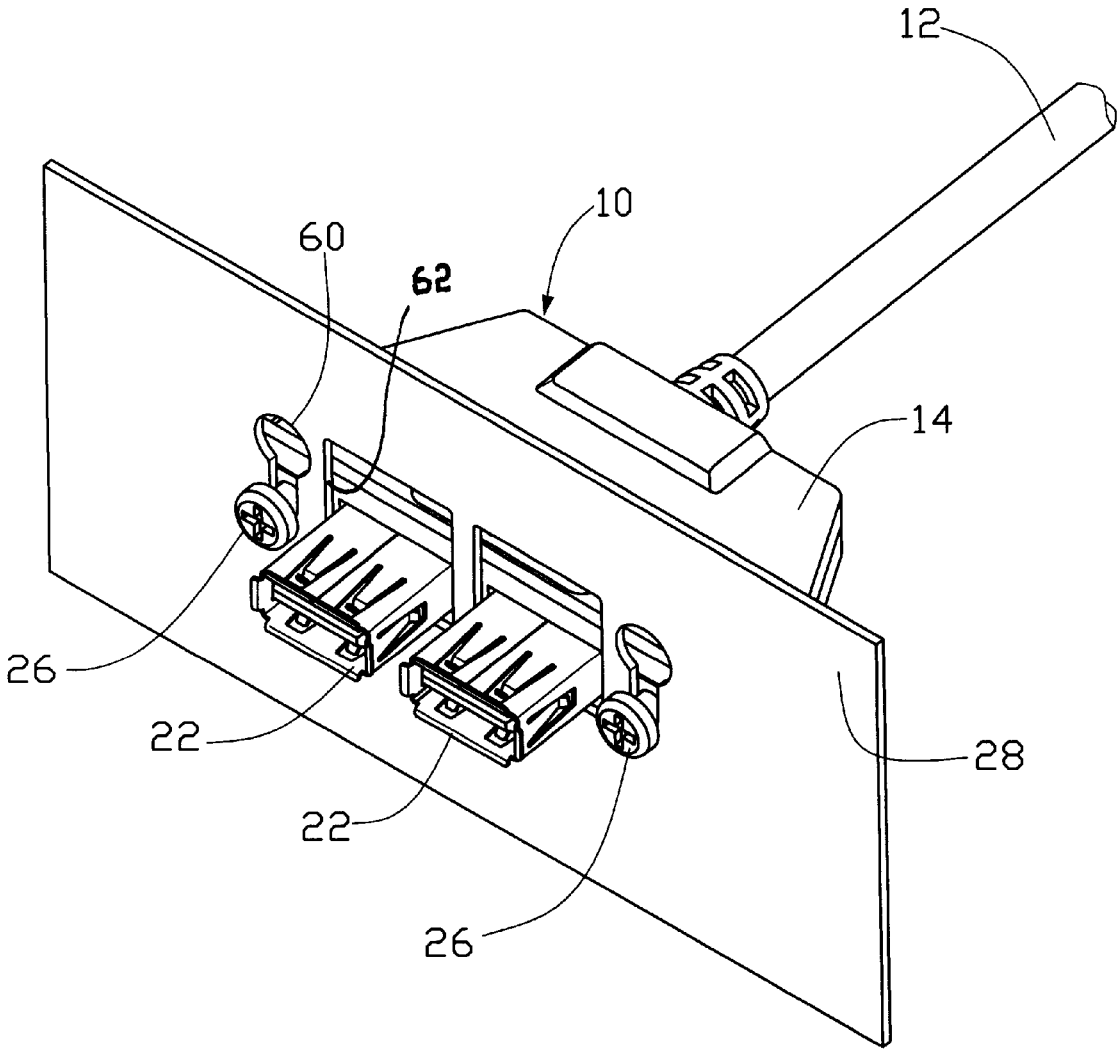
FIG. 6 is a perspective view showing the cable assembly mounted to the panel.

Also referring to FIGS. 4 and 6, two fasteners 26 are mounted in the casing 16 on opposite sides of the two USB connectors 22 for attaching the connection device 14 to a panel 28. Each fastener 26 comprises a threaded rod 30 having two expanded ends 32, 34. A nut 36 threadingly engages the threaded rod 30 of the fastener 26 whereby when the fastener 26 is rotated, the nut 36 is moved axially with respect thereto. A slot 38 is defined in a first expanded end 32 of the fastener 26 for engaging with a tool, such as a screwdriver, to tighten the fastener 26. In the embodiment illustrated, the slot 38 is cruciform for engaging a Philip type screwdriver, but it may be a straight one for engaging a flat screwdriver.

The threaded rod 30 is rotatably received in a bore 40 defined through the front wall 24 of the casing 16 with the first and second ends 32, 34 respectively located outside and inside the casing 16. A cavity 42 is defined in the front wall 24 for fixedly receiving the nut 36 whereby when the fastener 26 is driven by a screwdriver, the first end 32 is moved toward/away from the panel 28 for securing/releasing the connection device 14 to/from the panel 28. Preferably, the nut 36 is polygonal, such as hexagonal, and the recess 42 has a corresponding shape for fixedly accommodating the nut 36 therein.

Figure 5:
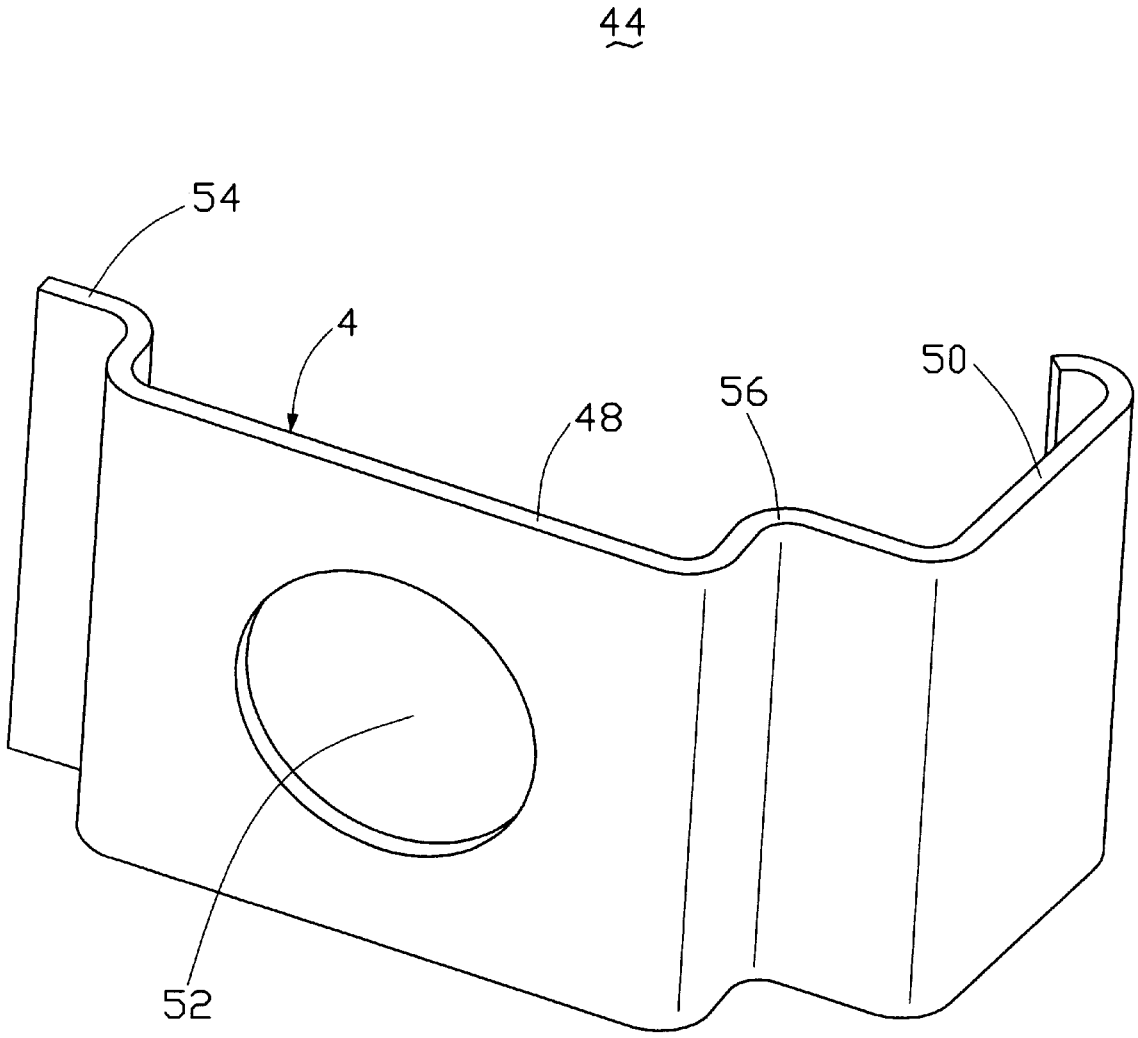
FIG. 5 is a perspective view of a grounding device of the USB cable assembly.

Also referring to FIG. 5, each fastener 26 comprises a grounding device 44 engaging with both the fastener 26 and a conductive shield 46 of the USB connector 22 adjacent thereto. The grounding device 44 comprises a substantially L-shaped conductive plate 4 having a first section 48 and a second section 50 substantially normal to each other. The first section 48 defines a hole 52 through which the threaded rod 30 of the corresponding fastener 26 extends. The first section 48 forms two stepliked edges 54, 56 with the second section 50 extending from the second edge 56. Two L-shaped slits 58 are defined in the front wall 24 of the casing 16 on opposite sides of each bore 40 for fixedly receiving the first and second step-like edges 54, 56 of the first section 48 thereby fixing the grounding device 44 in position with the first section 48 overlapping an outside surface of the front wall 24 and supported thereby and the second section 44 resiliently engaging the shield 46 of the corresponding USB connector 22.

Openings 60 are defined in the panel 28 for receiving and engaging with the fasteners 26. Each opening 60 comprises a circular hole (not labeled) having a diameter large enough to allow the first end 32 of the fastener 26 to extend therethrough and a reduced slot (not labeled) having a width smaller than the diameter of the circular hole but is sufficient to accommodating the threaded rod 30 of the fastener 26 therein with two banks thereof engaging with the first end 32 of the fastener 26. By tightening the fastener 26, the connection device 14 is secured to the panel 28 forming a surface contact the panel 28 and the front wall 24 of the casing 16. The first section 48 of the grounding device 44 electrically engages the panel 28 establishing an electrical connection between the panel 28 and the corresponding USB connector 22. Two slots 62 each having the similar vertical dimension to the opening 60, are defined in the panel 28 through which the USB connectors 22 first approach to the upper portions thereof and successively downwardly move, and thus project restrictedly in the lateral direction and beyond the panel 28 for engagement with mating connectors of other devices (not shown). The way of how to assemble the cable assembly 10 to the panel 28 through the fastener 26 of the cable assembly 10 and the opening 60 of the panel 28, can be mainly referred in the copending application 09/449,108 filed Nov. 24, 1999 with the title of "PANEL MOUNT ELECTRICAL CONNECTOR ASSEMBLY" and the same assignee with the invention.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A cable assembly comprising:

a cable having an end; and a connection device mounted to and electrically connected to the end of the cable, the connection device comprising:

an insulative casing having a front wall;

at least one electrical connector having a conductive shield, the electrical connector being arranged in the casing and electrically connected to the cable, the connector being exposed to the front wall for being adapted to engage a mating connector, at least one fastener comprising a threaded rod rotatably received in a bore defined in the front wall and having first and second expanded ends respectively located outside and inside the casing, a nut being fixed in the casing and engaging with the threaded rod whereby when the threaded rod is rotated, the threaded rod is axially moved with respect to the casing and the nut for securing the connection device to an external device, and grounding means comprising at least a conductive plate having a first section defining a through hole through which the threaded rod of the corresponding fastener extends and a second section engaging with the conductive shield of the connector, the first section being located outside the casing adapted to electrically engage an external grounding device;

wherein the first section comprises opposite step-like edges fixedly received in L-shaped slits defined in the front wall on opposite sides of the bore with the first section overlapping an outside surface of the front wall for engaging with the external grounding device;

wherein the second section is substantially normal to the first section for resiliently engaging with the conductive shield of the connector;

wherein the connector is a universal serial bus (USB) connector;

wherein the USB connector partially extends beyond the front wall of the casing for engaging with the mating connector;

wherein the external grounding device comprises a panel in surface contact with and secured to the front wall of the casing whereby the first section of the grounding means engages the panel;

wherein the panel defines an opening having a circular hole sized to allow the first expanded end of the fastener to extend therethrough and a reduced slot in communication with the circular hole and sized to accommodate the threaded rod of the fastener, the first end of the fastener being adapted to be drivingly engageable with a tool for tightening the fastener against the panel and the front wall of the casing thereby securing the connection device of the cable assembly to the panel;

wherein a slot is defined in the first end of the fastener for engaging with a screwdriver.

2. An electrical connector assembly adapted to be releasably mounted to an external panel comprising:

an insulative casing having a front wall;

at least one electrical connector having a conductive shield, the electrical connector being arranged in the casing and electrically connected to the cable, the connector being exposed to the front wall for being adapted to engage a mating connector, at least one fastener comprising a threaded rod rotatably received in a bore defined in the front wall and having first and second expanded ends respectively located outside and inside the casing, a nut being fixed in the casing and engaging with the threaded rod whereby when the threaded rod is rotated, the threaded rod is axially moved with respect to the casing and the nut for securing the connector assembly to an external device, and grounding means comprising at least a conductive plate having a first section defining a through hole through which the threaded rod of the corresponding fastener extends and a second section engaging with the conductive shield of the connector, the first section being located outside the casing adapted to electrically engage an external grounding device.

* * * * *